US006857547B1

(12) United States Patent
Lee

(10) Patent No.: US 6,857,547 B1
(45) Date of Patent: Feb. 22, 2005

(54) TRIGGERING DEVICE OF NAIL DRIVER WITH SINGLE SHOOTING MODE AND CONTINUOUS SHOOTING MODE

(76) Inventor: Yun-Chung Lee, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 10/773,865

(22) Filed: Feb. 9, 2004

(51) Int. Cl.[7] ..... B25C 1/04
(52) U.S. Cl. ..... 227/8; 227/130
(58) Field of Search ..... 227/8, 126, 130

(56) References Cited

U.S. PATENT DOCUMENTS 5,083,694 A * 1/1992 Lemos ..... 227/8
5,485,946 A * 1/1996 Jankel ..... 227/8
5,785,228 A * 7/1998 Fa et al. ..... 227/8
5,791,545 A * 8/1998 Lin ..... 227/8
5,836,501 A * 11/1998 Lai ..... 227/8
5,862,969 A * 1/1999 Lee ..... 227/8
6,213,372 B1 * 4/2001 Chen ..... 227/8
6,419,140 B1 * 7/2002 Chen ..... 227/8
6,581,814 B1 * 6/2003 Hsu ..... 227/8
6,588,642 B1 * 7/2003 Wang et al. ..... 227/8
6,641,018 B2 * 11/2003 Akiba ..... 227/8
6,662,989 B1 * 12/2003 Chang et al. ..... 227/8
6,675,999 B2 * 1/2004 Mukoyama et al. ..... 227/8
2002/0130154 A1 * 9/2002 Wolfberg ..... 227/8
2002/0175200 A1 * 11/2002 Liu ..... 227/130
2003/0121947 A1 * 7/2003 Hsu ..... 227/8
2004/0020966 A1 * 2/2004 Miller et al. ..... 227/130
2004/0045998 A1 * 3/2004 Akiba ..... 227/8

* cited by examiner

*Primary Examiner*—Scott A. Smith
*Assistant Examiner*—Gloria R. Weeks

(57) ABSTRACT

A triggering device of a nail driver has a single shooting mode and a continuous shooting mode. The triggering device is installed between a safety bar and a trigger of a driver body of the nail driver. The safety bar has an push sleeve extending out of a beating opening of the driver body; a trigger valve being on the driver body at an inner side of the trigger; a valve rod being in the trigger valve. When the trigger is triggered, the valve rod will be actuated so as to open the trigger valve to beat a nail. The trigger device comprises a swingable elastomer having a shape like a cambered hook and being pivotally installed within the trigger. A swingable end of the elastomer has at least one buckle. A hook is at one side of a swinging path of the elastomer. A tension spring is installed on the hook; and a movable rod is at another end of the swinging path of the elastomer. A compressible spring is installed on the movable rod which is assembled to the safety bar.

8 Claims, 5 Drawing Sheets

TRIGGERING DEVICE OF NAIL DRIVER WITH SINGLE SHOOTING MODE AND CONTINUOUS SHOOTING MODE

FIELD OF THE INVENTION

The present invention relates to nail drivers, and particular to a triggering device of a nail driver with a single shooting mode and a continuous shooting mode, wherein an cambered elastomer is provided, and two ends of the elastomer are pivotally installed with a hook and a movable rod. Moreover, the present invention relates to the adjustment of the length of the movable rod and a safety bar.

BACKGROUND OF THE INVENTION

In the prior art pneumatic nail driver, the ways for beating includes a single shooting mode and a continuously shooting mode. In the single shooting mode, each time, the trigger is pressed, only one nail is beaten once. In the continuous shooting mode, the nail is beaten continuously until the nail is beaten to a designated position in the work piece.

Above said two ways can be included in the same nail driver by using a switching structure to change between the single shooting mode and the continuous shooting mode. However, these technologies are based on manual operations for changing modes. Thereby, the user is inconvenient.

Otherwise, an auto switching nail gun for changing single shooting and continuous shooting modes are used, where a press section of a safety bar extends to an output of a driver body which can press the operation surface before beating so that the safety bar will touch a movable block so that the movable rod slides. Furthermore, timing for pressing a valve rod is controlled or the movable block is buckled by another actuating hook so as to generate a single shooting mode or a continuous shooting mode. This prior art can avoid the manual switching operation and avoid the mistake beating in shooting based on the user's operation processes and habits. However, this prior art needs many components and the structure is very complicated. As the strong vibration in beating, it will shorten the lifetime of the nail driver. Further since the safety bar is formed by hooking two components without the function of adjusting the length thereof, it is imperfect and is necessary to be further improved.

SUMMARY OF THE INVENTION

Accordingly, the primary object of the present invention is to provide a triggering device of a nail driver with a single shooting mode and a continuous shooting mode. The operation can be performed automatically and the number of components can be simplified. Moreover the length of the linking structure can be adjusted for controlling the nail beating depth.

Based on above object, the present invention includes a cambered elastomer in the trigger for replacing the elastic buckling structure in the prior art.

In the present invention, a movable rod is installed at a swinging path of the elastomer so that when the safety bar contacts a surface of a working piece, the elastomer can be pushed. Thereby, the trigger can be triggered.

Moreover, in the present invention, another elastic hook is installed at a swinging path of the elastomer. The elastomer will not restore after a single shot and before the release of the trigger. Thus the mistake in beating nail can be avoided.

In the present invention, the elastomer is flexible and swingable so that the trigger can be triggered continuously and thus to beat nails continuously. Thereby, the operation of beating nail is smoothly.

In the present invention, a button is used to be connected to a safety bar and a movable rod. The button serves to adjust the connection length of the safety bar and the movable rod. Thereby, the depth of the nail beating into the work piece is adjustable.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
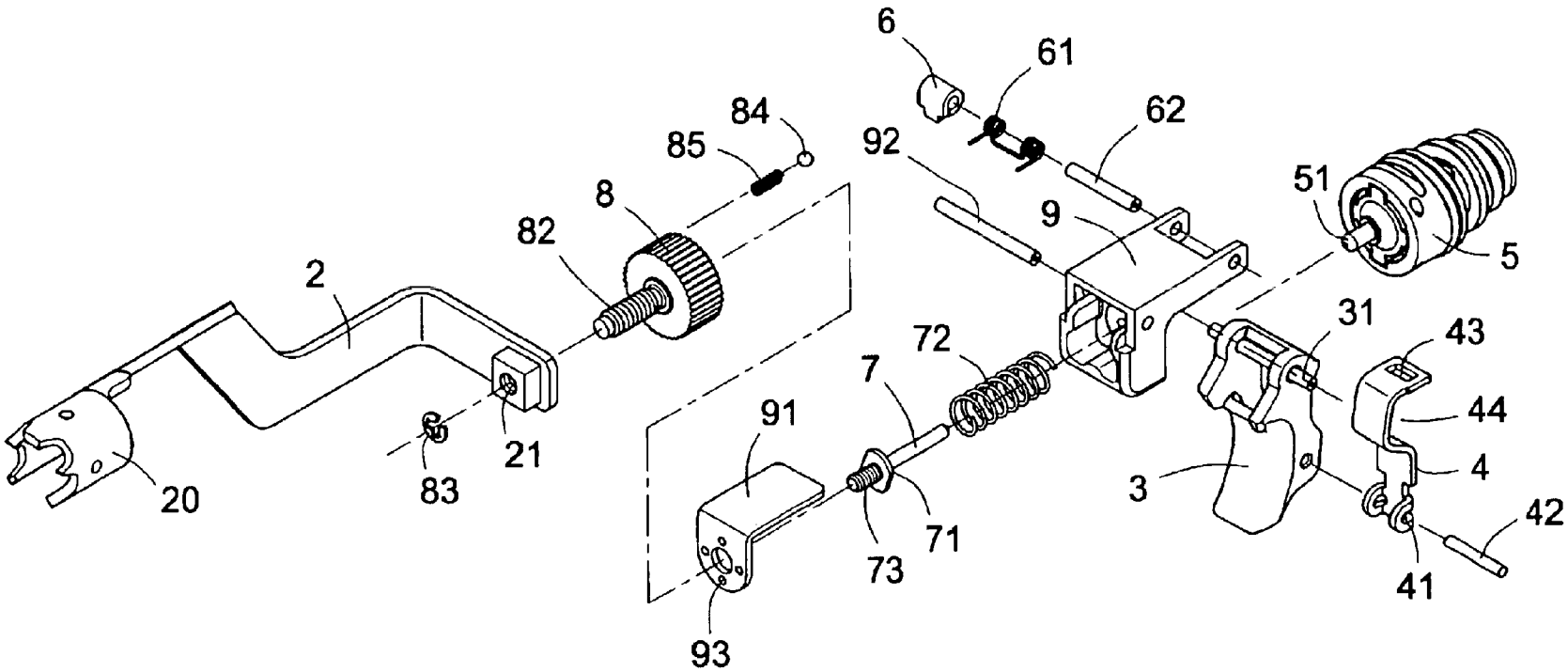
FIG. 1 is an exploded perspective view of the preferred embodiment of the present invention, where the arrangement of the components about the driving structure of the trigger is illustrated.
Figure 2:
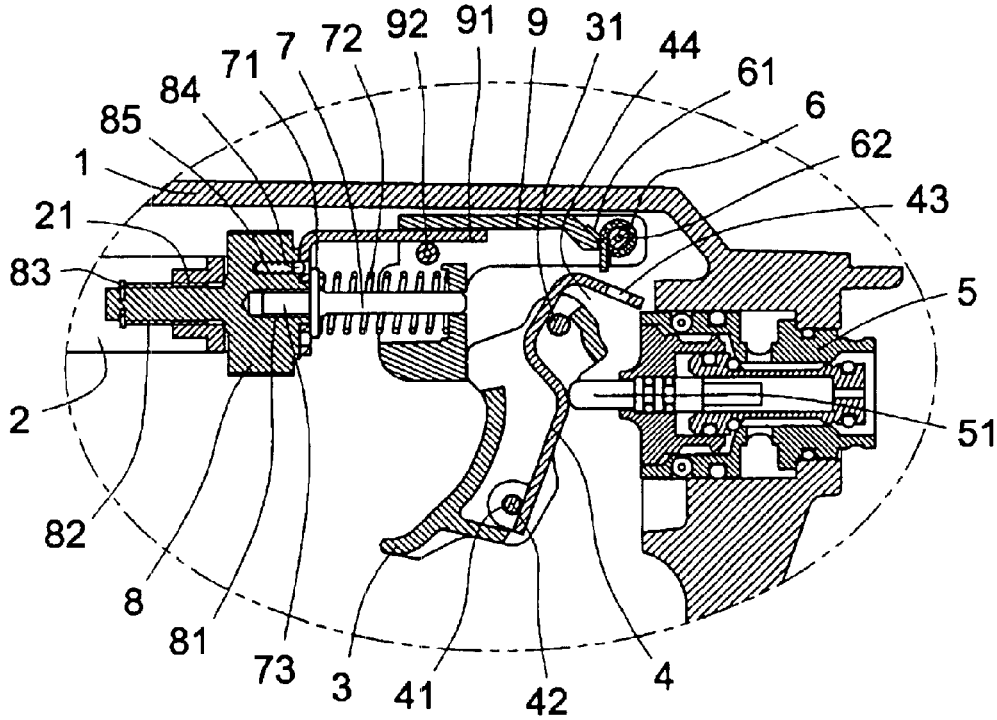
FIG. 2 is a cross section view of the preferred embodiment of the present invention, where the present invention is assembled to a driver body.

With reference to FIGS. 1 and 2, the trigger driving device of the present invention is installed to a safety bar 2 and a trigger 3 of the driver body 1. The trigger driving device includes swingable cambered elastomer 4. The safety bar 2 has a press end which extends out of a beating opening of the driver body 1. The press end is made as a push sleeve 20 with a plurality of teeth which can give a pressure to a work piece so that it becomes a driving piece for opening the safety bar before or in beating a nail. Meanwhile, the trigger 3 is pivotally installed to the driver body 1 by a retaining pin 31. The driver body 1 has a trigger valve 5 at the inner side of the trigger 3. A trigger valve rod 51 is installed in the trigger valve 5. Thereby, when the trigger 3 is pressed, the valve rod 51 will be triggered to beat the nail.

A pivotal connecting end of the elastomer 4 has two rings 41 at two sides thereof. A swingable end of the elastomer 4 has at least one buckle 43. The elastomer 4 is formed with a cambered portion 44. A pin 42 passes through the two rings 41 of the elastomer 4 and then the elastomer 4 is pivotally placed in the trigger 3.

A swinging path of the elastomer 4 has a hook 6 at one side thereof. In use, the hook 6 is assembled to a torsion spring 61. A pin 62 serves to assembled the torsion spring 61 to a seat 9. Besides, the hook 6 and the torsion spring 61 may be located to the driver body 1, but they still are placed at one side of the swinging path of the elastomer 4.

In use of the present invention, the buckle 43 of the elastomer 4 can be made with a buckling hole or a projection for buckling the hook 6.

Another side of the swinging path of the elastomer 4 is installed with a movable rod 7. A ring 71 is formed on the rod body of the movable rod 7. A spiral spring 72 encloses the movable rod 7 and resists against the ring 71. Moreover, in use, one end of the movable rod 7 far away from the spiral spring 72 can be assembled to the safety bar 2 by welding or screwing or integrally forming so that the movable rod 7 is as a push end of the safety bar 2. Thus it is driven thereto. For example, in one embodiment of the present invention, the rod wall of the movable rod 7 not being covered by the spring are formed with threads and is connected to the safety bar 2.

The movable rod with threads 73 can be locked to a threaded hole 81 of a button 8. A threaded rod 82 extends from one end of the button 8 so as to screw into the lock hole 21 at an assembled end of the safety bar 2. A distal end of the threaded rod 82 is enclosed by a stop ring 83. Thereby, the safety bar 2 is connected to the movable rod 7 by the button 8. The length of the connection between the safety bar 2 and the movable rod 7 is adjustable by the button 8. Thus, the gap between the press end and the beating opening of the safety bar 2 is adjustable. Thus, the beating depth of the nail is adjustable by the button 8.

A roller 84 and a compressible spring 85 are installed within the button 8. An L shape guide sheet 91 is clamped between the locking surfaces of the movable rod 7 and the button 8. A locking end of the guide sheet 91 is formed with a plurality of round holes 93. Thereby, the roller 84 in the button 8 can press the compressing spring 85 to be elastically buckled to one of the round holes 93. Thus, the button 8 can adjust the beating depth. Furthermore, a seat 9 is installed on the driver body 1 and between the movable rod 7 and the trigger 3. A pin 92 is installed in the seat 9 so that the guide sheet 91 can be embedded into the seat 9. By the pin 92 to support the guide sheet 91, the guide sheet 91 is driven by the movable rod 7 and the safety bar 2 so that it can move steadily in the seat 9 (referring to FIGS. 2 to 7) so that the operation is steady for a longer time.

By above components, the nails can be beaten one by one or continuously. The operation will be described herein.

For the operation of single shooting mode, the push sleeve 20 of the safety bar 2 is pushed to resist against a nailing position of the work piece so that the safety bar 2 is pushed to drive the movable rod 7 to push the elastomer 4. Thereby, the buckle 43 of the elastomer 4 is pushed to an acting end of the hook 6 and the cambered portion 44 of the elastomer 4 resists against the pin 31. Thereby, a single shooting mode with the elastomer 4 resisting against the movable rod 7 is formed (referring to FIG. 3). In this state, since the movable rod 7 is flexible, which can be pressed by the trigger 3 so that a middle section of the elastomer 4 will trigger the valve rod 51 of the trigger valve 5 to beat the nail in single shot (referring to FIG. 4). Meanwhile, an end portion of the buckle 43 of the elastomer 4 will swing to a stop position of the hook with the pressing of the trigger 3. The hook 6 will embed into the buckle 43 to stop the elastomer 4 so that the elastomer 4 cannot swing toward the movable rod 7.

Figure 3:
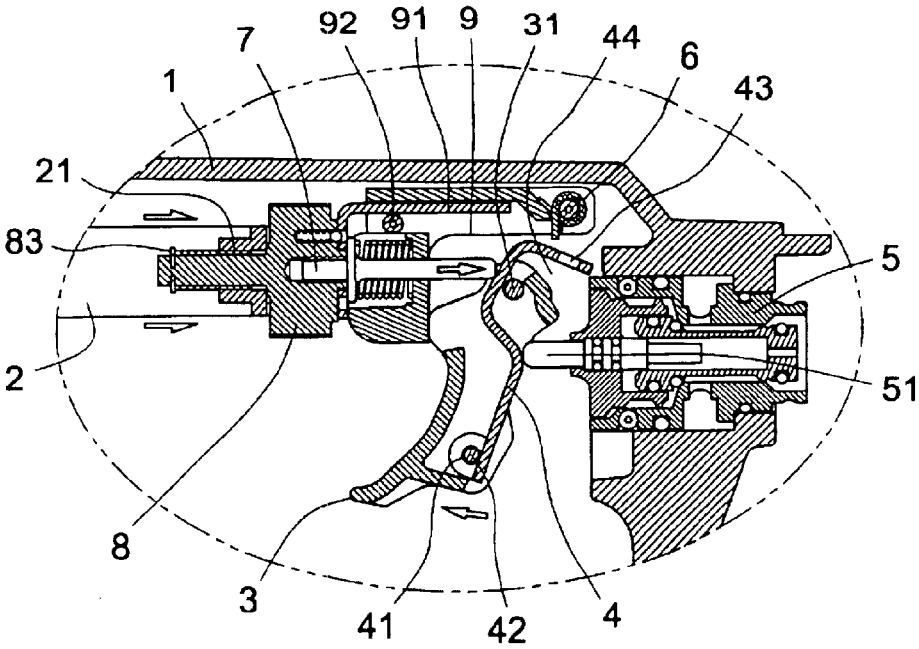
FIG. 3 is a cross section view of the preferred embodiment of the present invention, where the safety bar is pushed to drive the movable rod to eject the elastomer, in that the trigger is not triggered or is released.
Figure 4:
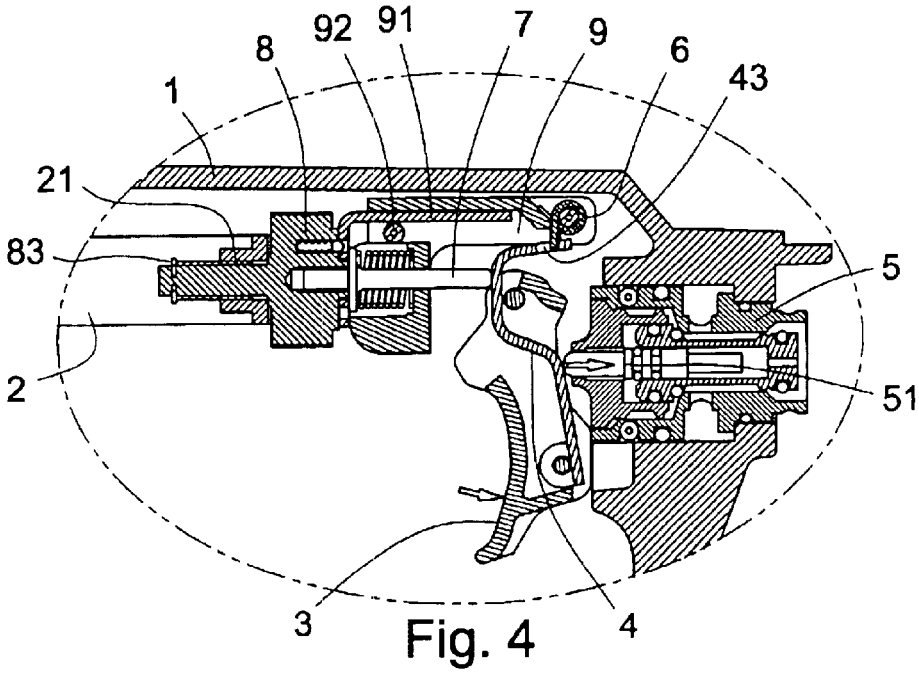
FIG. 4 is a cross section view of the preferred embodiment of the present invention, where in the state of FIG. 3, the trigger is pressed to drive the elastomer to trigger a valve rod to perform a single shot operation.
Figure 5:
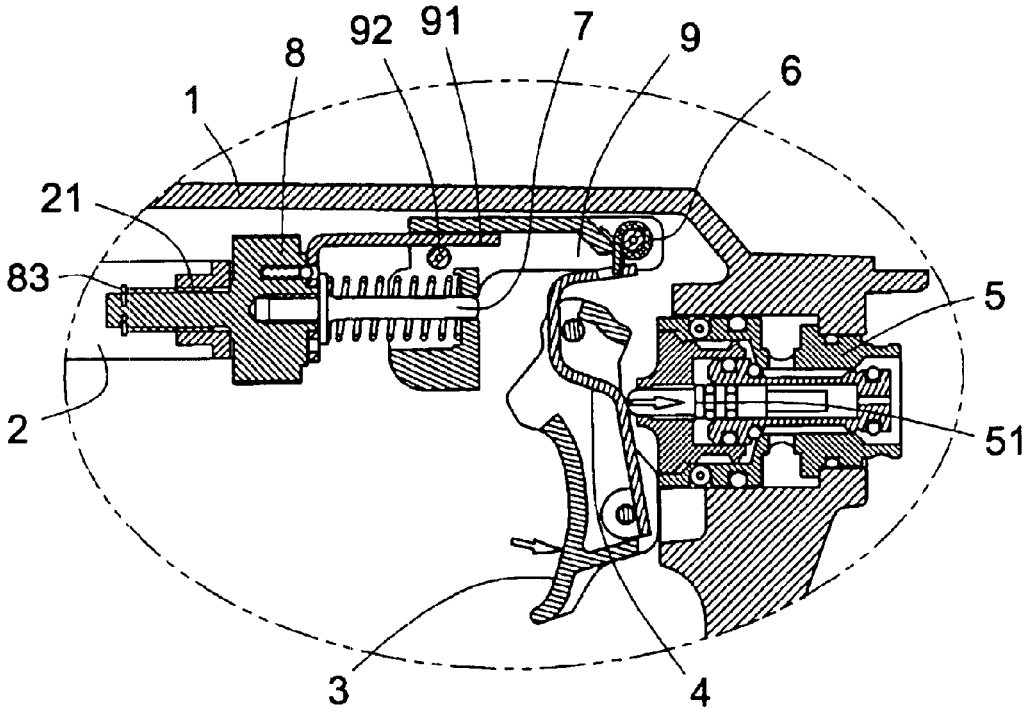
FIG. 5 is a cross section view of the embodiment of the present invention, where under the state of pressing the trigger and valve rod, the movable rod is returned by releasing the safety bar.

After the single shot operation shown in FIG. 4, if the user release the trigger 3 without releasing the safety bar 2, the valve rod 51 will return to the state without being triggered by the elastomer 4 (referring to FIG. 3). That is, in a preset mode of single shot, the user can trigger the trigger 3 again to make the valve rod 51 to be actuated (the state shown in FIG. 4 is repeated) so as to perform the second safety shot. Thereby, the single shot operation is performed one by one so as to beat the nail safely.

After the single shot shown in FIG. 4, if the user releases the safety bar 2 without releasing the trigger 3 and valve rod 51 (referring to FIG. 5), since the elastomer 4 in the trigger 3 will be resisted by the hook 6, the elastomer 4 will not swing toward the returned movable rod 7 due to the releasing of the safety bar 2. At this moment, if the user does not trigger the safety bar 2 and the movable rod 7 carelessly, since the state that trigger 3 presses the valve rod 5 to open the valve is not ended, the beating operation can not be performed again. Thereby, one pressing of the trigger 3 can only beat the nail once. Thereby, it is impossible to beat a nail by mistake.

Figure 6:
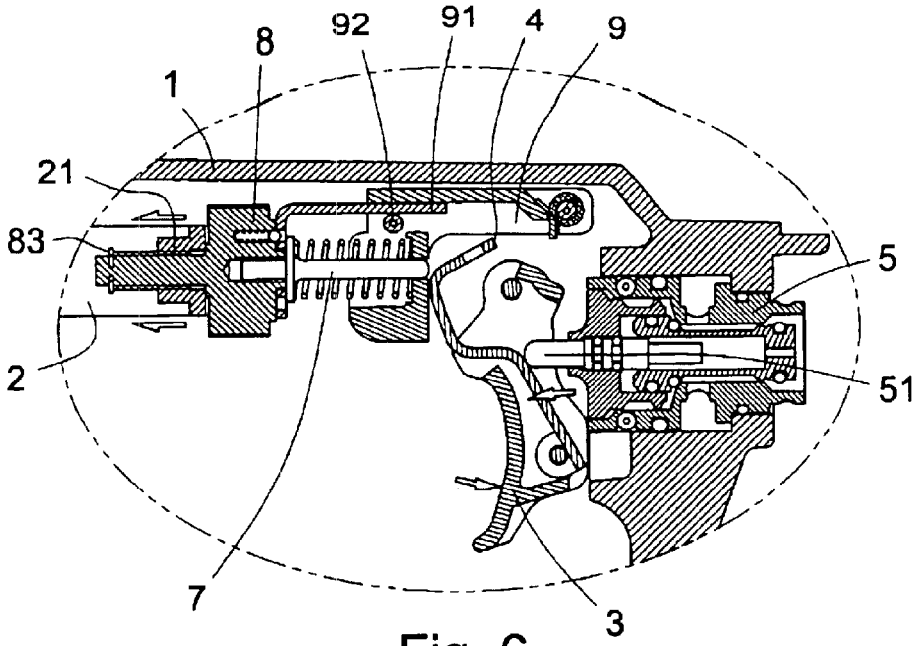
FIG. 6 is a cross section view of the embodiment of the present invention showing the operation that the trigger is pressed, but the safety bar and the movable rod are not driven.

For the continuous beating, before the user does not push the safety bar 2, the user must press the trigger 3 so that the elastomer 4 swings toward the movable rod 7, and the valve rod is in a state that it is not triggered and thus the nail is not beaten (referring to FIG. 6). Then, the user can align the push sleeve 20 of the safety bar 2 toward a plurality of objects and beat the nails continuously. At each beating, the safety bar 2 will drive the movable rod 7 to push the elastomer 4 (referring to FIG. 7). At this moment, one end of the elastomer 4 is resisted by the trigger 3, and another end thereof is pushed by the movable rod 7 so that the middle portion of the elastomer 4 drives the valve rod 51 to open the valve to beat the nail. In the continuous beating, when the trigger 3 is pressed and the safety bar 2 releases from the surface of the work piece (returning to the state shown in FIG. 6), the elastomer 4 and the valve rod 7 returns with the restoration of the movable rod 7 so that the user can move the safety bar 2 to beat nail again. Thereby, the repeating action of the safety bar 2, the nails can be beaten continuously.

Figure 7:
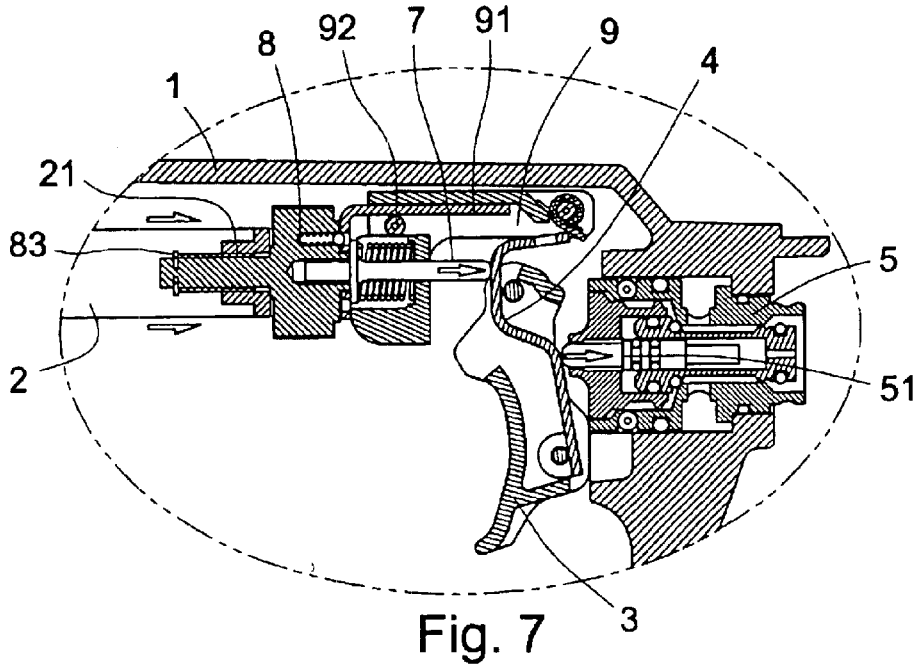
FIG. 7 is a cross section view about the embodiment of the present invention, where in the state shown in FIG. 6, the trigger is pressed, and the safety bar and movable rod are pushed to drive the elastomer to trigger the valve rod so as to actuate the action of beating a nail.

After the continuous beating shown in FIG. 7, if the action of the user is to release the trigger 3 without releasing the safety bar 2 on the surface of the work piece, the valve rod 51 will return to the original state without being triggered by the elastomer 4 and the buckle 43 of the elastomer 4 is pushed by the movable rod 7 toward the acting end of the hook 6 (referring to FIG. 3). Thereby, the operation of continuous beating is released and the operation is returned to the single shooting mode.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A triggering device of a nail driver with a single shooting mode and a continuous shooting mode; the triggering device being installed between a safety bar and a trigger of a driver body of the nail driver; the safety bar having an push sleeve extending out of a beating opening of the driver body; a trigger valve being on the driver body at an inner side of the trigger; the trigger valve having a valve rod; when the trigger is triggered, the valve rod will be actuated so as to open the trigger valve to beat a nail; the trigger device comprising a swingable elastomer having a shape like a cambered hook and being pivotally installed within the trigger; a swingable end of the elastomer having at least one buckle;

a hook at one side of a swinging path of the elastomer; and a tension spring being installed on the hook; and a movable rod at another end of the swinging path of the elastomer; a compressible spring being installed on the movable rod and the movable rod being assembled to the safety bar.

2. The triggering device of a nail driver with a single shooting mode and a continuous shooting mode as claimed in claim 1, wherein the buckle is a buckling hole.

3. The triggering device of a nail driver with a single shooting mode and a continuous shooting mode as claimed in claim 1, wherein the buckle is a projection.

4. The triggering device of a nail driver with a single shooting mode and a continuous shooting mode as claimed in claim 1, wherein the movable rod is integrally formed as a push end of the safety bar.

5. The triggering device of a nail driver with a single shooting mode and a continuous shooting mode as claimed in claim 1, wherein a section of the movable rod is threaded for locking a button; the button has a threaded rod for being connected to the safety bar.

6. The triggering device of a nail driver with a single shooting mode and a continuous shooting mode as claimed in claim 5, wherein an L shape guide sheet is clamped between the movable rod and the button; and the seat is installed on the driver body and between the movable rod and the trigger; a roller being installed in the seat for supporting the guide sheet.

7. The triggering device of a nail driver with a single shooting mode and a continuous shooting mode as claimed in claim 1, wherein by rotating the button, a distance from the safety bar to the movable rod is adjustable.

8. The triggering device of a nail driver with a single shooting mode and a continuous shooting mode as claimed in claim 1, wherein a section of the movable rod is threaded for screwing to the safety bar.

* * * * *